US012313279B2

(12) United States Patent
Dunberger et al.

(10) Patent No.: US 12,313,279 B2
(45) Date of Patent: May 27, 2025

(54) AIR PURIFIER

(71) Applicant: Blueair AB, Englewood Cliffs, NJ (US)

(72) Inventors: Lars Henrik Dunberger, Stockholm (SE); Alagirisamy Nethaji, Mumbai (IN); Johan Daniel Wennerström, Sollentuna (SE)

(73) Assignee: Blueair AB, Englewood Cliffs, NJ (US)

( * ) Notice: Subject to any disclaimer, the term of this patent is extended or adjusted under 35 U.S.C. 154(b) by 96 days.

(21) Appl. No.: 17/799,250

(22) PCT Filed: Feb. 10, 2021

(86) PCT No.: PCT/EP2021/053226
§ 371 (c)(1),
(2) Date: Aug. 11, 2022

(87) PCT Pub. No.: WO2021/160681
PCT Pub. Date: Aug. 19, 2021

(65) Prior Publication Data

US 2023/0078774 A1 Mar. 16, 2023

(30) Foreign Application Priority Data

| | | |
|---|---|---|
| Feb. 14, 2020 | (IN) | 202021006449 |
| Feb. 14, 2020 | (IN) | 202021006450 |
| Feb. 14, 2020 | (IN) | 202021006451 |
| Feb. 14, 2020 | (IN) | 202021006452 |
| Feb. 14, 2020 | (IN) | 202021006453 |
| Mar. 30, 2020 | (EP) | 20166873 |
| May 26, 2020 | (EP) | 20176488 |

(51) Int. Cl.

| | |
|---|---|
| ***F24F 11/77*** | (2018.01) |
| ***F24F 8/108*** | (2021.01) |
| ***F24F 8/192*** | (2021.01) |
| ***F24F 8/30*** | (2021.01) |
| ***F24F 8/80*** | (2021.01) |
| ***F24F 8/90*** | (2021.01) |
| ***F24F 13/20*** | (2006.01) |
| ***F24F 110/10*** | (2018.01) |
| ***F24F 110/20*** | (2018.01) |

(52) U.S. Cl.
CPC ..... *F24F 11/77* (2018.01); *F24F 8/108* (2021.01); *F24F 8/192* (2021.01); *F24F 8/30* (2021.01); *F24F 8/80* (2021.01); *F24F 8/90* (2021.01); *F24F 2013/205* (2013.01); *F24F 2110/10* (2018.01); *F24F 2110/20* (2018.01)

(58) Field of Classification Search
CPC ..... F24F 8/80; F24F 8/90; F24F 8/10; F24F 8/192; F24F 8/30; F24F 2110/10; F24F 2110/20; F24F 11/77; F24F 2013/205
See application file for complete search history.

(56) References Cited

U.S. PATENT DOCUMENTS

| | | | | |
|---|---|---|---|---|
| 2001/0029728 | A1* | 10/2001 | Massey | B01D 46/46 55/471 |
| 2002/0141131 | A1 | 10/2002 | Gorczyca et al. | |
| 2005/0116166 | A1* | 6/2005 | Krichtafovitch | H01T 19/00 250/324 |
| 2007/0034082 | A1* | 2/2007 | Adair | B03C 3/155 96/97 |
| 2016/0279556 | A1* | 9/2016 | Law | B01D 45/16 |
| 2019/0240371 | A1* | 8/2019 | Benedek | B01D 53/8675 |
| 2021/0207840 | A1* | 7/2021 | Clark | F24F 11/64 |
| 2023/0120319 | A1* | 4/2023 | Dunberger | F24F 8/10 422/4 |

FOREIGN PATENT DOCUMENTS

| | | | |
|---|---|---|---|
| CN | 1997440 | A | 7/2007 |
| CN | 105823131 | A | 8/2016 |
| CN | 206989439 | U | 2/2018 |
| CN | 207805227 | U | 9/2018 |
| CN | 108871823 | A | 11/2018 |
| CN | 104296307 | B | 12/2018 |
| EP | 1245289 | A2 | 10/2002 |
| JP | 2001104824 | A | 4/2001 |
| JP | 2005000648 | A | 1/2005 |
| JP | 2005003275 | A | 1/2005 |
| JP | 2008036466 | A | 2/2008 |
| WO | 2018058716 | A1 | 4/2018 |

OTHER PUBLICATIONS

International Preliminary Report on Patentability issued in International Patent Application No. PCT/EP2021/053226 dated Jan. 4, 2022.
European Search Report in corresponding European Patent Application No. EP20166873, dated Sep. 30, 2020 (7 pages).
International Search Report and Written Opinion in corresponding International PCT Application No. PCT/EP2021/053226, dated Apr. 20, 2021 (11 pages).

* cited by examiner

*Primary Examiner* — Henry T Crenshaw
(74) *Attorney, Agent, or Firm* — Carter, DeLuca & Farrell, LLP; George Likourezos

(57) ABSTRACT

An air purifier and methods to sterilize an internal surface of an air purifier. The air purifier includes a removable particulate or gas filter, an air flow generator, a controller for said air flow generator, a first air flow setting with an air filtration air flow speed, and a second air flow setting which correlates with sterilization of an internal surface of the air purifier and/or removable particulate or gas filter. The air flow speed measured at the removable filter at the second air flow setting is from 0.1 to 1.2 $cms^{-1}$.

10 Claims, No Drawings

AIR PURIFIER

The present invention relates to an improved air purifier.

US 2007 034 082 discloses an air purifier including an ionizing assembly that operates to charge particulate material in an air flow passing through the purifier. The charged particulate material is attracted to and retained by a filter element disposed downstream of the ionization assembly and having an electrical charge opposite to the charged particulate material. The purified air passing through the filter is directed out of the device, optionally in conjunction with a fragrance that is added to the purified air flow. The ionizing assembly is formed with a ground member disposed adjacent the ionizing member to keep the electrons generated by the ionizing assembly within the purifier, and thus prevent static discharges from occurring outside of the purifier. The air flow is directed by a fan through the purifier in an angular and substantially laminar manner, such that the efficiency of the purifier is increased.

US 2002 141 131 discloses an improved air ionizer apparatus includes an air inlet, a high voltage source, an electrode electrically connected to the high voltage source for generating ions and an air outlet. An air mover is provided for causing air to flow into the air ionizer through the air inlet and out of the air ionizer through the air outlet. A foraminous filter comprising an electrically conductive material is electrically coupled to at least one of a voltage source and ground. The filter is positioned over at least one of the air inlet, the air outlet and the electrode, such that air flowing into the air inlet, air flowing out of the air outlet or air flowing past the electrode flows through the filter. In a preferred embodiment, the filter comprises a metal grid or screen.

WO 2018/058716 discloses an all-in-one fresh air purifier, comprising a housing (1), an indoor return air inlet (21), an outdoor fresh air outlet (22), a fresh air delivery outlet (2), an indoor return air discharge outlet (12) and a power supply control device provided in the housing (1); provided in sequence in the housing (1) are a stage one filter (3), a heat exchange core (4), an exhaust fan (5), a stage two filter (6), an ion cloud dust removal module, an air blower (9) and a stage three filter (10); the exhaust fan (5), ion cloud dust removal module and air blower (9) are electrically connected to the power supply control device. The present all-in-one device combines ventilation and air purification functionality, is plug-and-play, presents no difficulties in installation and maintenance or structural problems of installing air pipes and damaging a room, has high negative ion generation, has a long conveying distance, has strong dust removal and disinfection effects, and furthermore does not generate ozone during operation, maintaining a healthy environment.

CN 105 823 131 discloses a fresh air purification combined system for a teaching area. The fresh air purification combined system comprises an air treatment assembly. The air treatment assembly comprises a fresh air ventilator and an air purifier. The fresh air ventilator and the air purifier are arranged independently and fixed to different positions in a room, and thus the indoor air quality can be controlled through combination. According to the fresh air purification combined system for the teaching area, through the combination of the constant-oxygen air purifier and the purification type fresh air ventilator, a constant-clean, constant-oxygen, energy-saving and green ecological classroom can be created, and a safe and clean study environment is provided for students.

Despite the prior art there remains a need for improved air purifiers, in particular air purifiers which are more hygienic throughout their working life.

Air purifiers work by filtering ambient air through a filter. Accordingly, anything in the air is in theory capturable by the filter. While there are different types of filtration means, from particulate filter to gas filter, it is a necessary consequence of the functioning of an air purifier that they also capture microbes caught in the air flow.

It is also a routine feature of air purifiers that the main focus is removing pollution from the ambient air and various sensors which indicate that particulates are being removed exist. Consequentially, it also is quite routine for an air purifier to work in an automatic mode whereby the presence of particulates influences the air flow speed through the device. Thus, when the air quality is good, it is possible and often desirable that the purifier is maintained in idle or stand-by mode to conserve energy.

However, when air is not passing through the purifier micro-organisms caught by the filter are able to grow quickly and form biofilms which can have a deleterious effect on effective filter life span and also cause a health hazard to the users who habit the domestic setting.

Accordingly, and in a first aspect, the present invention relates to an air purifier comprising a removable particulate or gas filter, an air flow generator, a means for controlling said air flow generator, a first air flow setting with an air filtration air flow speed and a second air flow setting which correlates with sterilisation of an internal surface of the air purifier and/or removable particulate or gas filter.

We have surprisingly found that a modest air flow rate can prevent growth of micro-organisms and drastically reduce the prevalence of live micro-organisms being blown into the ambient air and also released into the environment during filter change.

Such micro-organisms include gram positive bacteria, gram negative bacteria, spores, moulds and fungi as well as any viruses alone in the ambient air or harboured by any of these.

We have surprisingly found that by providing a low speed air draft we can drastically reduce micro-organism viability on the internal surfaces of the air purifier and in particular to the filter media. While the purifier is operating there is no increased risk of micro-organisms growing and multiplying on the filter. However, when it is in idle or stand-by mode the micro-organisms grow. The air flow speed required to reduce micro-organism viability is significantly lower than that required to filter the air and so can be achieved at a much lower energy consumption level. Further, the low air draft required to significantly affect the viability of the micro-organisms is far more effective than mere air drying.

In preferred embodiments of the invention the purifier ascertains the likelihood of conditions conducive to micro-organism growth and when such conditions are deemed to exist it actuates the air flow generator to destroy the microbes on the filter, or even those on the inside of the purifier.

We have surprisingly found that the air draft required to kill micro-organisms is significantly lower than that required for air filtration. Accordingly, in a preferred embodiment the air purifier comprises means for controlling said air flow generator, a first air flow setting with an air filtration air flow speed and a second air flow setting which correlates with sterilisation of an internal surface of the air purifier and/or removable particulate or gas filter.

The air flow speed measured at the removable filter is known in the art as the media velocity. Media velocity is the velocity at which the air travels through the filter. Media velocity has to be controlled perfectly to ensure that the maximum amount of particles are trapped. Too fast and many of the pollutants fly straight through unfiltered. Too slow and the purifier is not reaching the farthest corners of your room quickly enough to be effective. It is also important to appreciate that media velocity is the velocity at which the air passes through the filter and not just the velocity at which the air approaches the filter. This is an important distinction as the velocity at which the air approaches a pleated filter is significantly different therefore to the velocity at which the air passes through a pleated filter. The pleats in the filter having a significant impact on the calculation. It is preferred that the particulate filters used in the present invention are pleated.

Preferably, the air flow speed (media velocity) measured at the removable filter at the first, air filtration setting is at least 1.5 $cms^{-1}$. The measurement at the filter medium is taken from the spatial centre point on the fan side of the filter media surface. Where there is more than one filter medium, the one taken for the air draft measurement is the one which is closest to the air flow generator and so receives the air draft first.

Preferably, the air flow speed measured at the removable filter at the second setting is from 1 to 40% the air flow speed generated at the first setting.

Most preferably, the air flow speed measured at the removable filter at the second setting is from 0.7 to 1.1 $cms^{-1}$.

Preferably, the processor actuates the air flow generator to generate an air flow commensurate with sterilisation of an internal surface of the air purifier and/or a filter media for a period of from 1 second to 10 hours.

Preferably, the air purifier comprises a means for actuating said second air flow setting. Said means may comprise a knob or switch indicated to the user that a 'sterilisation mode' is selectable and that this is different to an air filtration mode.

In a preferred embodiment the means for controlling the air flow generator based on input from sensors and is conducted automatically, for example by a processor making reference to a look-up table. In such an embodiment the sensors sense the temperature and/or humidity on a continuous or intermittent basis and send information back to the processor. The processor determines whether the conditions are conducive to micro-organism growth based on at least temperature or humidity. Preferably, the processor determines whether the conditions are conducive to micro-organism growth based on temperature and humidity. More preferably, the processor determines the likelihood of micro-organism growth additionally based on parameters such as geographical location, time of the day, week, month or season or even the pollution levels as well as any specific conditions that occur, for example virus pandemics or bush fires, and combinations of any of these.

For example, in Asia, the wet seasons are typically defined by the monsoon and occurs in the summer. In contrast the summer in Europe and North America is characterised by drier weather. Similarly, the hemispheres have different seasonal characteristics.

Preferably, the geographical location is determined by GPS or through the purifiers WIFI capability. It may also be provided by way of user input during a set-up process.

When the processor determines that the conditions are conducive to micro-organism growth it either provides an indication, for example by way of a visual or audible signal, or electronically to a remote device such as a mobile phone so that the user is notified that the air flow generator should be employed, or it automatically actuates the fan or impeller at a low speed as described herein and which is sufficient to prevent micro-organism growth or to directly destroy the micro-organisms. Preferably, the purifier has first mode in which the choices are either: no action, where the conditions determined by the humidity sensor and temperature sensor are such that no or low micro-organisms growth is anticipated; an alert by way of an electronic signal to a mobile device to alert the user that conditions are favourable to micro-organisms and permitting the option for the user to actuate the fan; and a warning level where the user is warned that micro-organism growth is likely and strongly recommending to the user to actuate the fan or impeller.

A second mode may operate similarly in that indications are made determined by the input from the temperature and humidity sensors but instead of a warning or an alert, the machine is automatically turned on when conditions are such that micro-organism growth is likely.

The user of course may select one of these two modes where appropriate.

Temperature sensors are known in the art and are commercially available from Sensirion. Suitable examples of temperature sensors indude STS3x series.

Humidity sensors are known in the art and are commercially available from Sensirion. Suitable examples of humidity sensors include SHT3x series.

Preferably, the air purifier comprises a timer for timing the period since last air filtration event. More preferably, the purifier comprises means for indicating to the user the time period since last actuation. Said means for indicating may form part of the purifier per se or instead may be an electronic signal to a portable electronic device for example on a mobile phone where an app may function in conjunction with the purifier to provide information on for example air quality as well as functioning of the purifier.

In a second aspect there is provided a method for sterilising an internal surface of an air purifier as described herein by generating an air flow correlating with said second air flow setting.

In a third aspect there is provided a method for preventing microbial growth on an internal surface of or a removable filter from an air purifier by automatically activating the air flow generator.

Preferably, the air flow generator is activated after a pre-determined period of time since last activation of said air flow generator. For example, after a period determined either by the ambient conditions such as temperature and/or humidity the purifier may comprise a processor capable of determining the appropriate period between uses such that the growth of micro-organisms inside the device whether on or in the filter media or on surfaces inside the device is limited or reduced. The period of time between uses may also depend on geographical location as described above. The purifier is powered by any suitable power source including internal sources, e.g. batteries, and external power sources. The power is used to drive a motor which in turn powers at least the air flow generator and the ioniser where present.

Preferably, the filter media comprises at least one of carbon, activated carbon, a non-woven, a thermoplastic, a thermosetting material, a porous foam, fibreglass, paper, a high loft spunbound web, a low loft spunbound web, a meltblown web and or a bi-modal fiber diameter meltblown media.

Preferably, the removable particulate filter is a High Efficiency Particulate Air (HEPA) filter. It is to be understood that while the filter part of an air purifier is a vital part of its function, air purifiers are not commonly manufactured with a filter in place. They are practically always manufactured separately and most importantly often by a different commercial enterprise than of the manufacturer of the air purifier itself. It is also typical for a manufacturer of filters to manufacture filters for different air purifier models made by different manufacturers. The particulate filter is to be contrasted with the pre-filter or any dust filter which is present. Pre-filters and dust filters are not considered HEPA filters as they do not have the particulate capturing capability exhibited by HEPA filters. Preferably, the filter is pre-charged before application to the air purifier.

Pre-filters are filters which have a low air resistance and also function as a poke guard, preventing the user from touching the volute or impeller assembly. The pre-filters are not intended to exhibit any major effect in the context of air purification. They do not have the air resistance or particle entrainment capability of dedicated particulate filters. Preferably the pre-filter is not a HEPA filter. The purifier of the inventions also comprises a fan or impeller. The fan may be a bladeless fan, an axial fan but it is preferred that the fan is a radial fan.

Preferably, the air purifier comprises an ioniser. Preferably, the ioniser comprises a corona discharge tip and a receiving electrode. When the corona discharge tip is subjected to an appropriate electric voltage it generates an ion cloud between the tip and the receiving or ground electrode.

The ioniser may be disposed on the interior or the exterior of said purifier. Where the ioniser is disposed on the exterior of said device it is preferred that it is disposed at the top of the device. Locating the external ioniser at the top of the device means that domestic dust particles are ionised as they fall through the air towards the ground and are therefore more likely to aggregate as they become charged. As they become more aggregated they are more easily caught up in the air circulation pattern created by the device and so more easily filtered.

Where the ioniser is disposed in the interior of the device it is preferred that it is located before the removable particulate filter in an air flow direction.

Preferably, the device comprises an interior ioniser and an exterior ioniser. The exterior ioniser facilitating aggregation of domestic dust particles and the interior ioniser facilitating capture of the aggregated dust particles by the removable particulate filter. In both instances the ionisation permits less dense filtration media and low air speed (fan) speeds.

EXAMPLE 1

The following experiment sets out to assess the impact of a low air draft alone on micro-organism viability on a substrate, in this case a particulate filter. No ionisation of the substrate took place.

The micro-organisms used were *Staphylococcus aureus* and *Pseudomonas aeruginosa* and the incubation period to generate the biofilm was 5 days.

Results:

| Airflow rate ($ms^{-1}$) | 0.018 | 0.4 | 1 |
|---|---|---|---|
| Log reduction microbes | −0.75 | 0.52 | 1.2 |

A low air draft of 0.018 $ms^{-1}$ resulted in no reduction of micro-organism growth though this still resulted in some slowing down of growth.

EXAMPLE 2

An air purifier was set up such that a particulate filter was subjected to ionisation as well as a low air draft (1 $cms^{-1}$). The air draft was for 10 hours and the ionisation for 2 hours with the ionisation step coming first.

Again, the ioniser was set at −5 kV and the test micro-organism (*Staphylococcus aureus* and *Pseudomonas aeruginosa*) was allowed to grow for 5 days prior to the test.

The control showed log micro-organism count of 6 while the test score was 2.5.

EXAMPLE 3

An air purifier was set up such that an interior surface of the purifier was subjected to ionisation as well as a low air draft (1 $cms^{-1}$). The air draft was for 10 hours and the ionisation for 2 hours with the ionisation step coming first.

Again, the ioniser was set at −5 kV and the test micro-organism (*Staphylococcus aureus* and *Pseudomonas aeruginosa*) was allowed to grow for 5 days prior to the test.

The control showed 152 colonies of micro-organism while the test score showed 6.

The invention claimed is:

1. An air purifier comprising a removable particulate or gas filter, an air flow generator, a controller for said air flow generator, a first air flow setting with a first air filtration air flow speed, and a second air flow setting which correlates with sterilization of an internal surface of the air purifier and/or removable particulate or gas filter and wherein a second air flow speed measured at the removable filter at the second air flow setting is from 0.1 to 1.2 $cms^{-1}$ and the second air flow speed prevents micro-organism growth, wherein the processor controls the air flow generator to operate at the second air flow setting when the processor receives input from sensors and determines conditions are conducive to micro-organism growth.

2. The air purifier according to claim 1 wherein the air flow speed measured at the removable filter at the first setting is at least 1.5 $cms^{-1}$.

3. The air purifier according to claim 1 wherein the air flow speed measured at the removable filter at the second setting is from 1 to 40% the air flow speed generated at the first setting.

4. The air purifier according to claim 1 wherein the air flow speed measured at the removable filter at the second setting is from 1 to 10% the air flow speed generated at the first setting.

5. The air purifier according to claim 1 further comprising a timer for timing a period of time after a previous air filtration ends.

6. The air purifier according to claim 1 comprising a knob or switch for actuating said second air flow setting.

7. A method for sterilizing an internal surface of an air purifier according to claim 1 wherein sterilizing is achieved by generating an air flow correlating with said second air flow setting.

8. The method for sterilizing according to claim 7 wherein the internal surface is a removable filter.

9. A method for preventing microbial growth on an internal surface of a removable gas filter from an air purifier according to claim 1 by activating the air flow generator.

10. The method according to claim 9 wherein said air flow generator is activated after a predetermined period of time since last activation of said air flow generator.

* * * * *